US006932539B2

(12) United States Patent
Benedict

(10) Patent No.: US 6,932,539 B2
(45) Date of Patent: Aug. 23, 2005

(54) PERMANENT AND SEMI-PERMANENT GROYNE STRUCTURES AND METHOD FOR SHORELINE AND LAND MASS RECLAMATION

(75) Inventor: Charles E. Benedict, Tallahassee, FL (US)

(73) Assignee: Benedict Engineering Co., Inc., Tallahasse, FL (US)

( * ) Notice: Subject to any disclaimer, the term of this patent is extended or adjusted under 35 U.S.C. 154(b) by 36 days.

(21) Appl. No.: 10/759,075

(22) Filed: Jan. 20, 2004

(65) Prior Publication Data

US 2004/0206516 A1 Oct. 21, 2004

Related U.S. Application Data

(63) Continuation of application No. 10/158,124, filed on May 31, 2002, now abandoned.

(51) Int. Cl.[7] ..... E02B 3/08

(52) U.S. Cl. ..... 405/34; 405/35; 405/30; 405/21; 405/15; 405/302.6

(58) Field of Search ..... 405/302.6, 15, 405/21, 22, 25, 30, 31, 33, 34, 35

(56) References Cited

U.S. PATENT DOCUMENTS

| | | | | |
|---|---|---|---|---|
| 534,919 A | | 2/1895 | Sewall | |
| 867,802 A | | 10/1907 | Cottrell | |
| 897,369 A | | 9/1908 | Howland et al. | |
| 1,060,357 A | | 4/1913 | Nies | |
| 1,165,906 A | | 12/1915 | Rhoades | |
| 1,877,113 A | | 9/1932 | Young | |
| 2,514,119 A | | 7/1950 | Boccia | |
| 3,333,420 A | | 8/1967 | Henson | |
| 3,387,458 A | | 6/1968 | Jarlan | |
| 3,426,536 A | | 2/1969 | Danz | |
| 4,710,056 A | | 12/1987 | Parker | |
| 4,738,563 A | | 4/1988 | Clark | |
| 4,861,193 A | | 8/1989 | Newkirk | |
| 5,255,997 A | | 10/1993 | Bailey et al. | |
| 5,348,419 A | | 9/1994 | Bailey et al. | |
| 5,360,295 A | | 11/1994 | Isacksen | |
| 5,536,111 A | | 7/1996 | Doernemann | |
| 5,636,939 A | | 6/1997 | Brown | |
| 5,720,573 A | | 2/1998 | Benedict et al. | |
| 5,807,024 A | | 9/1998 | Benedict | |
| 5,833,387 A | * | 11/1998 | Tackney | 405/34 |
| 5,857,805 A | | 1/1999 | Chappell | |
| 5,944,443 A | | 8/1999 | Benedict | |
| 6,481,926 B2 | | 11/2002 | Benedict et al. | |
| 6,558,075 B2 | | 5/2003 | Benedict et al. | |
| 6,722,817 B2 | | 4/2004 | Benedict et al. | |

FOREIGN PATENT DOCUMENTS

| | | |
|---|---|---|
| IT | 565640 | 8/1957 |

* cited by examiner

*Primary Examiner*—Frederick L. Lagman
(74) *Attorney, Agent, or Firm*—Dowell & Dowell, P.C.

(57) ABSTRACT

The method and apparatus for shoreline land mass reclamation which includes replacement of at least one groyne section along a shoreline wherein the section includes a pair of spaced stanchions which are connected by at least one linkage member which supports vertically extending baffle elements and wherein the at least one linkage member is piovtably connected such that the spaced stanchions may be vertically adjustable relative to one another.

26 Claims, 8 Drawing Sheets

PERMANENT AND SEMI-PERMANENT GROYNE STRUCTURES AND METHOD FOR SHORELINE AND LAND MASS RECLAMATION

CROSS REFERENCE TO RELATED APPLICATION

This application is a continuation of application Ser. No. 10/158,124, filed May 31, 2002 now abandoned, in the name of the same inventor. Benefit of the filing date of the parent application is claimed with respect to this application.

BACKGROUND OF THE INVENTION

1. Field of the Invention

The present invention is directed to porous groyne-like structures and method for their use in reclaiming beaches, shoreline areas and other land masses which are subject to erosion by natural forces and, more specifically, to permanent and semi-permanent groyne structures which may be left in place when deployed. In some embodiments the groynes may be systematically raised as reclamation progresses from the buildup of silt, sand, shells, dirt, twigs and branches, grasses and other materials.

2. Description of Related Art

Beach and other shoreline erosion, especially in coastal areas, is a major concern to property owners who have residences or establishments which are situated in close proximity to the shoreline. Not only is there a tremendous personal and economic loss caused by damage to, or loss of, real estate, housing and commercial buildings by shoreline or beach erosion, but there is also recreational loss of waterfront property which adversely affects the general public.

To deter coastal erosion in many areas, large seawalls are constructed to prevent high tides from reaching land and property. Such structures are costly and are only practical when population densities make it economically reasonable to construct them. Further, such structures have an adverse effect on the natural appearance of the shoreline and, in many areas, cannot be practically constructed.

Other methods of shoreline reclamation include creating jetties or artificial barriers or reefs which extend from the shoreline. These structures are permanent installations and are generally utilized to prevent sand along coastal areas from washing out to sea or filling in inlets and the like by wave action. Like seawalls, however, such structures are costly to construct and maintain and, in some areas, are not appropriate for use due to the shoreline configuration, prevailing currents or tidal activity and the like. Also, such structures create a safety hazard in areas where recreational activity is anticipated.

A further method for reclaiming shoreline areas and preventing erosion is the placement of off-shore, underwater barriers. Often, large porous structures are placed along a sea floor or riverbed at some distance from the existing shoreline. The structures are provided to break wave, current or tidal action thereby creating a zone of low velocity water flow adjacent a beach or riverbank so that sand, silt and other particulate material will settle out of the water before being conveyed by fluid currents out from the shoreline. Again, such outer barriers are only appropriately used in some locations and are not appropriate for use in many locations and may be objectionable for use in some areas due to the adverse affect on aquatic life.

Other methods which are widely used to reclaim shorelines or beaches are dredging and sand impartation. When major dunes along a shoreline are damaged or washed away during heavy storms, it is often necessary to import new dirt and sand to re-establish the dunes to provide a natural barrier to tidal activity. Dredgers are commonly utilized to pump sand from a sea floor or riverbed to build up natural barriers. Such methods of shoreline reclamation, however, are temporary measures, at best, and do not provide a long-term solution to shoreline erosion. Further, such restoration methods are extremely costly and are not practical in many locations.

In view of the foregoing, there is a need to provide a method and apparatus for economically reclaiming damaged shorelines, and other land mass beach areas which can be practically used without an adverse effect to either land or water environments. In U.S. Pat. Nos. 1,969,123 and 4,710,056, methods and structures for beach restoration are disclosed which utilize netting for purposes of trapping sand, shells and other particulate matter carried by wave action. Nets are extended outwardly from the shoreline and are left in place until a buildup of sand and other particulate matter is established after which the nets, which may be buried several feet or more in the newly collected material, are withdrawn by winches or other means. The removal of the netting material can adversely affect the restored shoreline by creating trenches or furrows which form natural channels in which water flows away from the shoreline thereby conveying particulate matter back to a body of water.

In prior U.S. Pat. Nos. 5,720,573 and 5,944,443, screen or netting structures for groynes are disclosed wherein the screens are periodically raised as material is deposited during reclamation so as to reduce interference with newly deposited materials. During use, flexible materials such as screening and netting are effective for material build-up, however, under some deployment conditions such as during violent storms and sea surges, such groyne structures can be significantly damaged. Damage to screening or netting mandates added cost for required repair and replacement in order to maintain an effective groyne system.

Also, many groyne systems, such as described in the aforementioned patents, are specifically designed to be removably deployed. In some areas, such as along coastal or other shorelines it may be more beneficial to deploy or erect groyne systems which are designed to be semi-permanent or permanent. Such groyne systems must be constructed to with stand the forces encountered including wind, wave and tidal action over extended periods of time.

SUMMARY OF THE INVENTION

The present invention is directed to a method and apparatus for reclaiming shoreline, beach and offshore areas which includes the installation of semi-permanent or permanent groyne structures defined having a plurality of posts or stanchions which are embedded in a sea floor, or in other areas, so as to be in spaced relationship with respect to one another, such as extending from a shoreline to an off shore area and between which are mounted a plurality of rigid or semi-rigid vertical baffle elements such as slats, sheet pilings, beams and the like which are designed to be driven or embedded at their lower ends into the sea floor or other land mass. The vertical baffle elements may be horizontally spaced or overlapping with respect to one another but are spaced sufficiently to allow the passage of water therethrough with the spacing being established to control the settling of particles and debris carried by water currents. In some embodiments, the baffle elements are structurally shaped such as I-beams, H-beams, U-beams, T-beams, Z-beams and the like in order to provide for structural integrity of each element and also to facilitate the creation of tortuous fluid flow passages therebetween. The baffle elements may be formed of essentially any material which is resistant to deterioration in water, and especially salt water, and may be plastic, metal or any other appropriate material. Preferred metals are those treated to prevent corrosion, such as Corten™ steel, which can resist corrosion for periods of thirty or forty years or more. Double or triple hot dipped galvanized metals are also preferred materials.

The stanchions which are placed at the ends of each predetermined number or set of baffle elements are also preferably formed of corrosion resistant materials which can be left in place in aquatic environments including along a river, bay, gulf or along the shore of an ocean. The stanchions are generally larger than the baffle elements and may be formed of structural members including box beams, I-beams galvanized and other corrosion resistant pipes, beams and the like.

In some embodiments, each pair of stanchions are pivotally connected to the set of intermediate baffle elements by way of at least one, and preferably two or more, horizontal reinforcing bars which are moveably secured at their ends to the spaced stanchions. In some embodiments, elongated slots are provided in the ends of each bar through which guide pins, which are secured to the stanchions, extend. The pins may be formed of bolt-like structures with enlarged heads or may be more fixedly mounted such as by welding pins to the stanchions after passing the body of the pins through the slots or openings in the reinforcing bars. The baffle elements may also pivotally secured to the reinforcing bars by pivot pins which again may be removably or fixedly secured to the baffle elements.

In other embodiments, the baffle elements may be interengaged with one another along their vertical edges such that adjacent baffle elements may be moved vertically with respect to one another but cannot be separated horizontally once they are deployed. In these embodiments, if horizontal re-enforcing bars are used, they need not be connected directly to the baffle elements but may extend between the spaced stanchions on one or both sides of the baffle elements.

In those embodiments where vertically spaced reinforcing bars are used to secure the sets of baffle elements or members between each pair of stanchions, a first horizontal bar is provided adjacent an upper portion of the stanchions and the baffle elements with at least one second lower bar being placed so as to be spaced above the floor of the sea bed or other body of water in which the stanchions and the baffle elements are to be driven or otherwise set into place.

In the preferred embodiments, each groyne section, which includes a pair of spaced stanchions and an intermediate set of baffle elements, are designed to be driven into the sea floor as an unit such as by jetting, vibrating, drilling, impact driving and the like. To facilitate the placement of each unit of the groyne structures, an upper cap member may be provided which extends between the upper end of each stanchion and is secured thereto, thereby rigidity each unit when the unit is placed into service.

Each groyne structure may consist of one or a plurality of stanchion and baffle element sections which are preferably, but not necessarily, placed in end-to-end relationship extending outwardly from a shoreline to offshore with the height of the structure being such that the sections of the structure extend generally above a high tide water line of the body of water. Because of the difference in size between the stanchions and the baffle elements, the stanchions are generally more deeply embedded in the sea floor with the baffle elements being shaped to facilitate penetration in the sea floor but not necessarily to the same depth as the stanchions.

The groyne structures of the invention are specifically designed so that they may be permanently placed into service for a prolonged period of time, such as for years. However, one of the benefits of the structures of the invention is that they may also be treated as semi-permanent structures. Therefore, when environmental or other conditions require, the structures may also be readily vertically adjusted or removed. In this respect, because of the relationship between the stanchions and the reinforcing bars and the baffle elements, it is possible to elevate the stanchion sections by raising one of the stanchions of each section at a time. The reinforcing bars act as a pivot linkages between the stanchions and, when two or more bars are used and placed in parallel relationship with respect to one another, they act as parallel linkages. Because of the relative movement which is possible between the reinforcing bars and each stanchion due to the elongated slots in the bars, one stanchion may be elevated relative to the other stanchion of a section while maintaining the integrity of the spacing of the baffle elements relative to one another such that they remain in parallel vertical relationship with respect to one another when being raised. In order to raise each groyne section, any upper cap member associated therewith may be removed prior to the elevation of the section.

The groyne structures or systems of the invention may also incorporate one or more outer groyne sections or units which extend generally perpendicularly with respect to the other sections to form outer T-shaped walls or breakwaters for the groyne systems to further facilitate the disruption of wave, current, and tidal activities and thereby further facilitate the settling of particles and debris along the groyne structures.

In some embodiments, the reinforcing bar linkages may be provided only on one side of the stanchions and vertical baffles of each groyne section or unit whereas, in others, they may be provided on opposite sides of each groyne section.

As previously noted, each of the baffle elements of the invention may be formed of metallic or other appropriate material structures such as a T-beams, H-beams, I-beams, U-beams, Z-beams, box beams and the like. To create tortuous flow paths between the baffle elements, when shaped structural elements are used, the elements may be varied in their positional relationship with respect to one another. By way of example, if T-shaped beams are used, they may be alternately placed with the body of the T-beam extending in opposite directions so that generally Z-shaped fluid passageways are created between the baffle elements.

In further variations of the invention, especially when structural baffle elements are used, an upper end of each baffle element may include a tongue extension having an opening therein. The extensions are designed to pass through an opening or a slot provided in the cap member of each groyne section such that a bar may be extended through the openings of each of the tongue extensions to thereby secure each of the baffle elements in vertically set relationship with respect to one another along the full length of the groyne section or the entire groyne structure.

In some embodiments, as opposed to individual groyne sections or units, it is possible that elongated groynes may be created by providing a plurality of spaced stanchions, between each pair of which are a set of vertical baffle elements. The horizontal bars may extend along the entire length defined by the plurality of spaced stanchions with slots being provided to allow the bars to horizontally shift relative to the stanchions in the same manner as previously described with respect to the groyne sections. In this respect, it is possible to provide numerous sets of vertical baffle elements between the spaced stanchions which can be elevated vertically with respect to one another due to the relationship between the horizontal reinforcing linkage bars and the stanchions and baffle elements.

In those embodiments where the baffle elements are suspended by integrally formed tongues or interfitted with respect to one another, it is not necessary for the elements to be pivoted or otherwise attached to the horizontal reinforcing linkage bars. This facilitates the manner in which the groyne structures can be assembled and reduces the overall cost by reducing the number of pivot points which are necessary with each groyne structure. By suspending each of the vertical members from a common hanger and by providing the pivot linkage between the stanchions and reinforcing bars, it is still possible to raise one end of a groyne section relative to the other end even with a plurality of stanchions provided in each section.

In addition to utilizing the spacing and tortuous flow path established between the baffle elements of the invention to promote settling of solids out of moving water, the invention also utilizes space openings which can be provided in each of the baffle elements. The openings may be of differing sizes and of differing configurations. The openings further facilitate the settling of solids within the water by altering the velocity of the water as it passes through the openings.

It is a primary object of the invention to provide a method and apparatus for economically reclaiming land including along shorelines and off shore areas of oceans, gulfs, inlets, bays, rivers, lakes as well as other areas wherein currents, wave, tidal or other activities are experienced and wherein the structures exhibit permanent or semi-permanent characteristics being sufficiently strong and rigid to withstand the stresses imparted by strong storm surges and heavy tidal activity.

It is yet the further object of the invention to provide groyne structures and methods for installing such structures wherein the structures may be semi-permanently installed but may be raised or elevated and removed when necessary after land has been reclaimed without disturbing the natural contour of the reclaimed land.

It is yet another object of the invention to provide groyne structures to reclaim shorelines which are environmentally compatible and which will not deteriorate by exposure to normal environmental conditions including ultraviolet light, sand impingement sea water.

BRIEF DESCRIPTION OF THE DRAWINGS

A better understanding of the invention will be had with respect to the accompanying drawings wherein:

FIG. 8' is an enlarged cross sectional view taken along line 8'—8' in FIG. 7;

FIG. 8" is partial section of the linkage bar 72 showing several of the spacers integrally formed on the baffle side thereof;

DESCRIPTION OF THE PREFERRED EMBODIMENTS

With continued reference to drawing figures, a first embodiment of groyne 30 is shown as being deployed along shoreline "S" of a gulf, ocean, lake, river or the like such that the structure extends along the shoreline to off shore with the height of the structure being such that it extends generally above a high water line "H". The groyne structure is designed to be permanent or semi-permanent however, when environmental or other conditions require, the groyne may also be readily elevated or removed or adjusted so as to not adversely affect movement of aquatic life.

Figure 2:
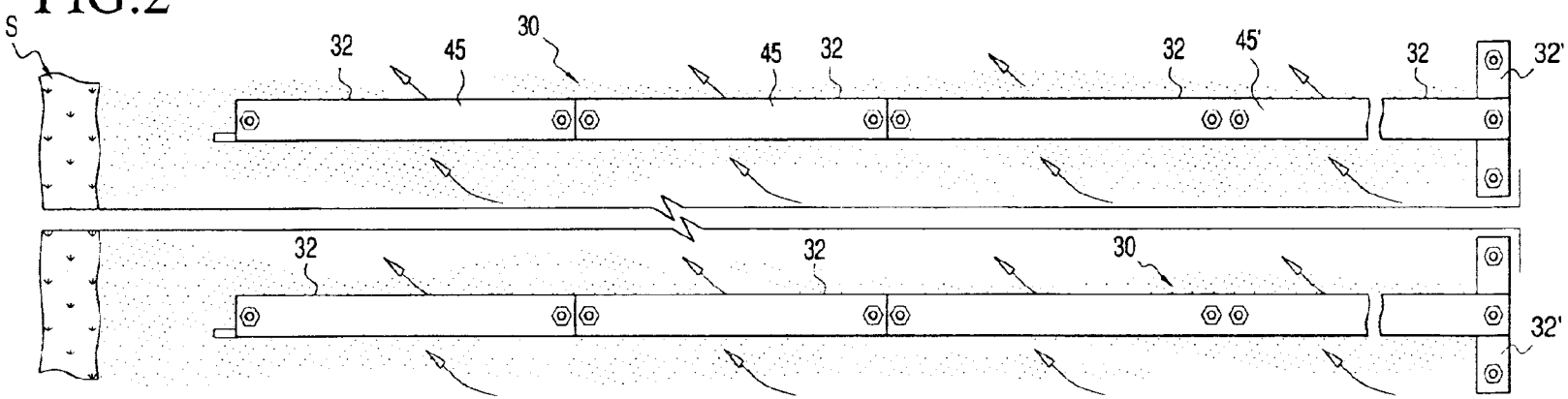
FIG. 2 is a top plan illustrational view showing a pair of groyne structures as shown in FIG. 1 being deployed from the shoreline to the off shore.

The groyne 30 includes a plurality of groyne sections or units 32 which are positioned generally in alignment with one another extending from the shoreline to offshore. The alignment with respect to the shore may be substantially perpendicular, as shown in FIG. 2 wherein two groyne structures are shown as being in generally parallel relationship with respect to one another. As opposed to extending perpendicularly from the shoreline, the groyne structures may extend at different angles depending upon the nature of the currents, wave action, winds and the like which are encountered in the area of the shoreline. The movement of the currents is generally shown by the arrows in FIG. 2.

Figure 1:
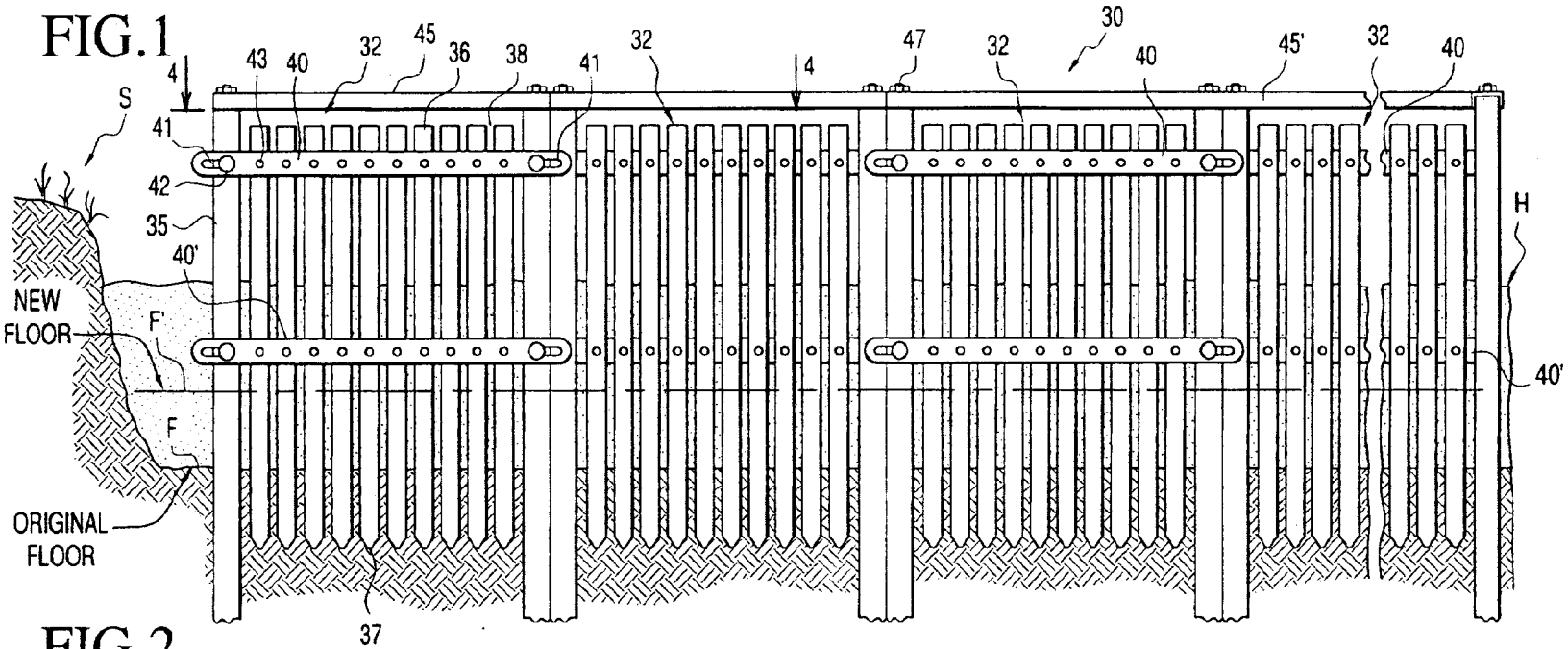
FIG. 1 is a side illustrational view showing a first embodiment of groyne structure in accordance with the invention with the structure being deployed from a shoreline and extending off shore.

In the embodiment shown in FIGS. 1 and 2, in addition to groyne sections 32 being deployed in relatively end-to-end relationship with respect to one another, one or more of the groyne sections may be positioned to provide a breakwater at the outer end of each groyne. These groyne sections are shown at 32' in drawing FIG. 2. Although the groyne sections 32' are shown as being somewhat smaller than the sections 32 in the drawing figures, their size may be identical or larger than the other groyne units. The purpose of the sections 32' at the end of each groyne is to create a breakwater to reduce the fluid velocity as currents push water toward the shoreline to further facilitate the settlement of solids being carried by the water.

Each groyne section in the embodiment shown in FIGS. 1 and 2 includes a pair of spaced stanchions, posts, piles or other structural poles 35 which are preferably formed of non-corrosive materials such as treated wood or galvanized or other treated metals in such forms as pipes, box beams, I-beams, and the like. The stanchions may also be formed as concrete pilings or of steel materials including materials made from Corten™ steel to resist corrosion. When concrete pilings are used, they may be surface coated with plastic to resist deterioration.

The lower ends of each of the stanchions are designed to be driven into a sea floor in appropriate manner such as by jetting, vibrating, drilling, driving and the like.

The size of the groyne section 32 may vary and thus the spacing between the stanchions 35 may also vary depending upon the area in which the groynes 30 are to be deployed. Generally, the groyne sections will be anywhere from 6' to 12' from end to end. The groyne section 30 may be attached as shown in FIG. 1 or detached and separate from one another.

To create a tortuous flow path and barrier for the flow of water relative to the groynes, the invention utilizes generally permanent or semi-permanent rigid and self-supporting vertical baffle elements 36 which are mounted to the spaced stanchions 35. In this respect, a set of a predetermined number of such baffle elements is positioned between each pair of stanchions 35. Each baffle element has a lower end 37 which is preferably formed into a pointed configuration to facilitate the driving of the lower end of each baffle element into the sea floor, as shown in FIG. 1, wherein each groyne section 32 has been set into place as previously described. It should be noted that the baffle elements 36 do not necessarily extend to the same depth in the sea floor as the stanchions as it is only necessary that the lower ends be positioned generally adjacent to or just below the original level of the sea floor at the area of deployment. As material is trapped and separated and settled out of the water, the material will collect and build up relative to the lower portion of the baffle elements and, over a period of time, will establish a new sea floor as shown at F' in FIG. 1.

The width and length dimension of each of the baffle elements 36 may vary and will depend upon the nature of the groyne to be deployed. In the drawing figures, ten vertical elements are shown between the spaced stanchions. This number will vary depending upon a relative spacing 38 to be established between each of the baffle elements and the widths of the baffle elements. The spacing generally will not exceed approximately one inch but may be substantially more or less depending upon the nature of the current flow, the tidal activity and the types of solids which are encountered in the area in which the groyne is to be deployed.

In the embodiment shown in FIG. 1, each of the baffle elements is shown as being disposed in space relationship generally in line between each of the stanchions 35. In embodiments to be described hereinafter, the baffle elements may overlap or be staggered relative to one another creating more tortuous flow paths or spacings therebetween.

To rigidly and assemble the spaced stanchions 35 and the plurality or set of baffle elements 36 with respect to one another, at least one upper horizontally extending reinforcing bar or linkage member 40 is provided with each groyne section 32. The bar linkage 40 includes outer ends including elongated slots 41 therein for purposes of allowing relative horizontal shifting movement of the bar linkages 40 relative to connecting pins or bolts 42 by way of which the bars are connected to the stanchions 35. In some embodiments, the pins 42 may be welded or otherwise attached to the stanchions 35 to form a very permanent connection whereas pins 42 may also be formed as bolts or other appropriate means which can be removably mounted to the stanchions 35.

Pivot pins 43 are used to connect each of the baffle elements 36 to the bar linkage 40 so as to permit a relative rotational movement therebetween.

Figure 3:
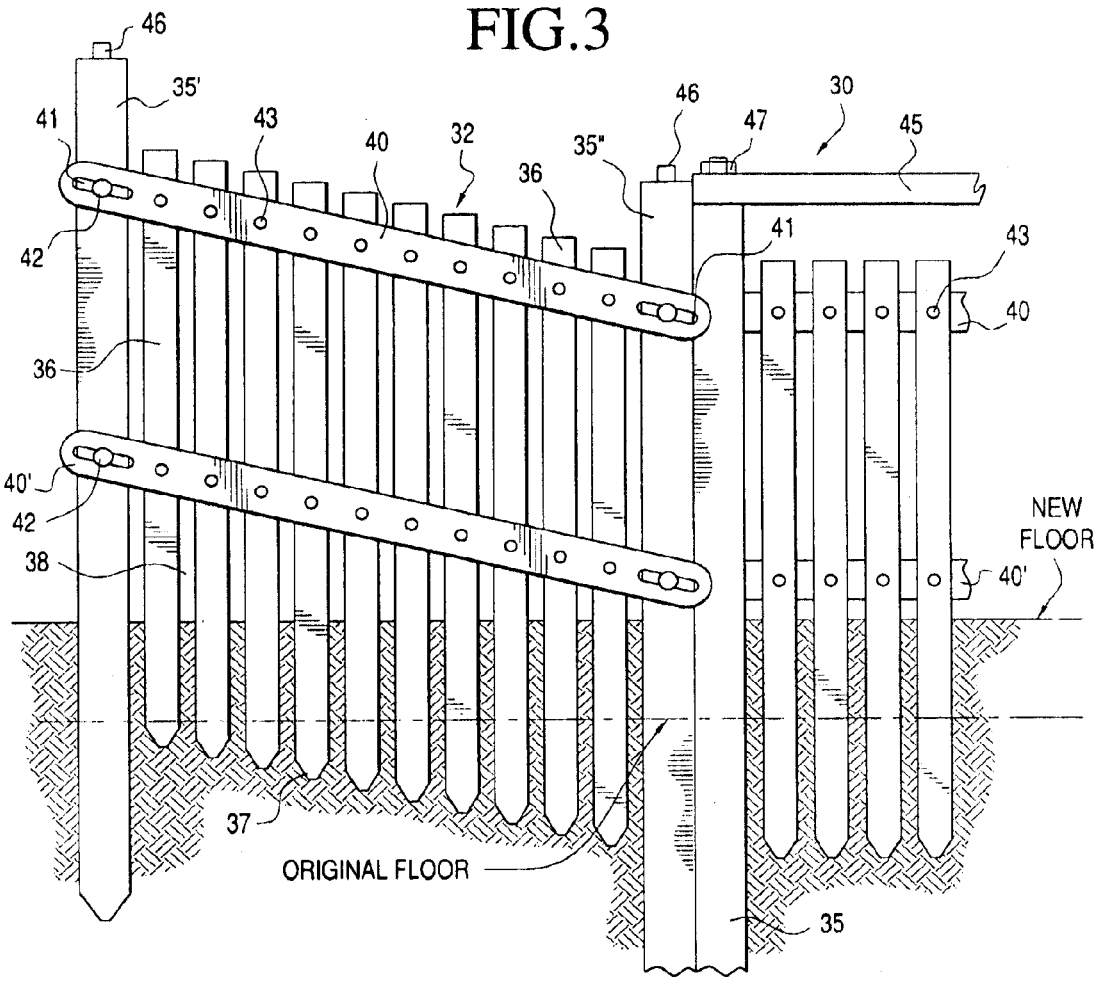
FIG. 3 is a side illustrational view of a portion of the groyne structure shown in FIG. 1 showing one section of the groyne being selectively elevated.
Figure 4:
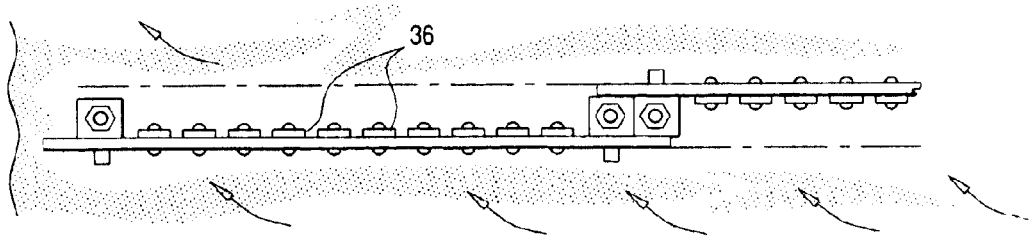
FIG. 4 is a top plan view of the section of groyne shown in FIG. 3.

In preferred embodiments, at least two or more reinforcing bar linkages 40 are used with each groyne section 32. In this respect, in drawing FIG. 1, a lower bar linkage 40' which is identical to that of the upper bar linkage 40 is shown as being connected in the same manner to the stanchions and the intermediate set of baffle elements 36. The bar linkages 40 and 40' form generally parallel linkage assemblies with the stanchions 35 which allow a relative elevational movement between each of the stanchions and the intermediate baffle elements as is shown in FIG. 3. In some instances it may be desired to elevate a groyne section, or to selectively elevate portions of each groyne or groyne section. With the structure of the invention, one stanchion such as shown at 35' in FIG. 3 may be elevated relative to another stanchion 35" with the linkages 40 and 40' allowing the set of baffle elements 36 to be raised relative to one another while maintaining the spacing 38 therebetween such that the baffles retain their generally parallel relationship when one side of the groyne section is elevated relative to the other, as shown in the drawing figure.

The structure as set forth above reduces the amount of energy or force required to selectively elevate each groyne section, as it may be progressively elevated first from one stanchion 35' then from another stanchion 35". The groyne sections may be raised by appropriate hoist, crane, or other elevating device which may be selectively secured to the stanchions 35 or to the reinforcing bar linkages 40 and 40'.

The bar linkages 40 associated with each of the groyne sections 32 shown in drawing FIG. 1 are placed only on one side of the groyne section. In some embodiments, bar linkages 40 may be provided on opposite sides of each groyne section to thereby create a more rigid structure. In drawing FIG. 1, the bar linkages are shown as being placed alternatively in front or behind the groyne sections 32 such that they do not interfere with one another when the units are being raised as shown in FIG. 3.

Although the baffle elements 36 shown in FIGS. 1–4 are relatively flat or plainer in configuration, the elements may be formed of other cross-sectional configurations and be within the teachings of the invention. In this respect, each baffle could have a spaced outer flange which would extend across the space 38 towards an adjacent element 36 but being spaced therefrom so that a generally Z-shaped flow path is created between the elements to further facilitate the manner in which solids are deposited out of the flow of water passing therebetween.

In the embodiment shown in FIGS. 1–3, a further provision is made for rigidifying the groyne either before or after each section is deployed. Each section includes an elongated cap member 45 which is generally an inverted U-shaped configuration and which is secured at its ends to studs extending from the stanchions 35 by any appropriate mechanical fasteners 47. In this respect, lifting rings, not shown, can be used to connect the ends of the cap member 45 to the stanchions to facilitate the connection of a hoist hook or other elevating device.

To provide additional integrity and rigidity to the deployed groyne sections, and as shown on the two groyne sections to the right in FIGS. 1 and 2, the cap structure 45 may extend along more than one groyne section as shown at 45'. In this respect, the groyne sections are rigidly connected to one another by the elongated cap structure 45'.

Whenever elevation of a groyne section is required, the cap structure of 45 or 45' must be removed in order to allow the relative elevation of the sections in the manner shown in FIG. 3.

With specific reference to FIGS. 5 through 9, a second embodiment of the invention is disclosed in greater detail. In this embodiment, groyne 50 is shown as including a plurality of groyne sections 52 which are interconnected with one another to form an extended groyne extending outwardly from the shoreline. As with the previous embodiment, shorter groyne sections 52' may be provided generally perpendicularly thereto at the outer end of the groyne structure to provide a breakwater. In this embodiment, a plurality of stanchions 55 are provided in spaced relationship with respect to one another along the length of the groyne as shown in FIG. 3. Although the groyne sections 52 may be formed in the same general manner as the embodiment of FIG. 1 wherein each section includes opposite end stanchions, the separate sections may be somewhat integrally formed such that there are no intermediate pairs of stanchions along the length of the groyne. Intermediate each of the stanchions 55 are a plurality or set of vertical baffle elements 56 having lower ends 57 which are designed to be embedded in the sea floor as previously discussed with respect to the embodiment in FIG. 1. In a like manner, stanchions 55 are generally designed to be driven deeper into the sea floor "F" as discussed with respect to the previous embodiment.

Figure 6:
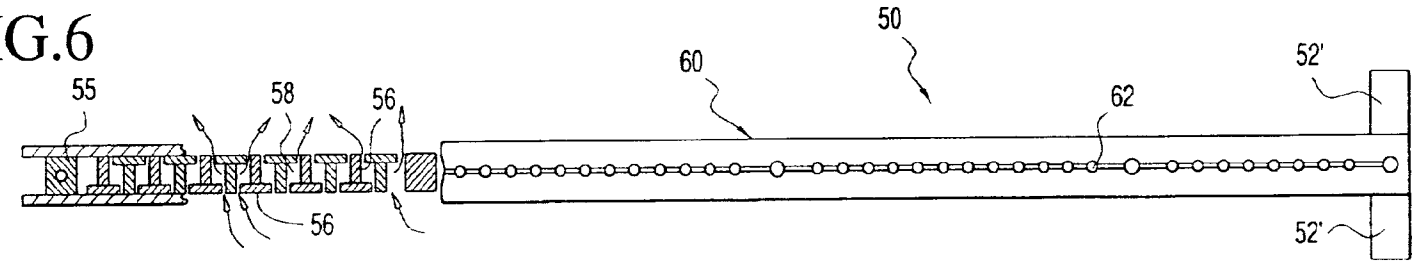
FIG. 6 is a partial section taken along line 6—6 of FIG. 5 and showing an upper cap of the groyne structure of FIG. 5.

As shown in FIG. 6, in the present embodiment, each of the baffle elements 56 has a structurally configured cross section. In the embodiment shown, each element has a T-shaped configuration. The orientation of adjacent elements 56 are offset with respect to one another to thereby create tortuous flow paths or spacings 58 between each of the elements, as exemplified by the arrows in FIG. 6. As with the previous embodiment, the relative spacing between each of the elements 56 may vary and the number and width of elements between each stanchion 55 may also vary depending upon conditions existing in the area where a groyne 50 is to be deployed.

Figure 7:
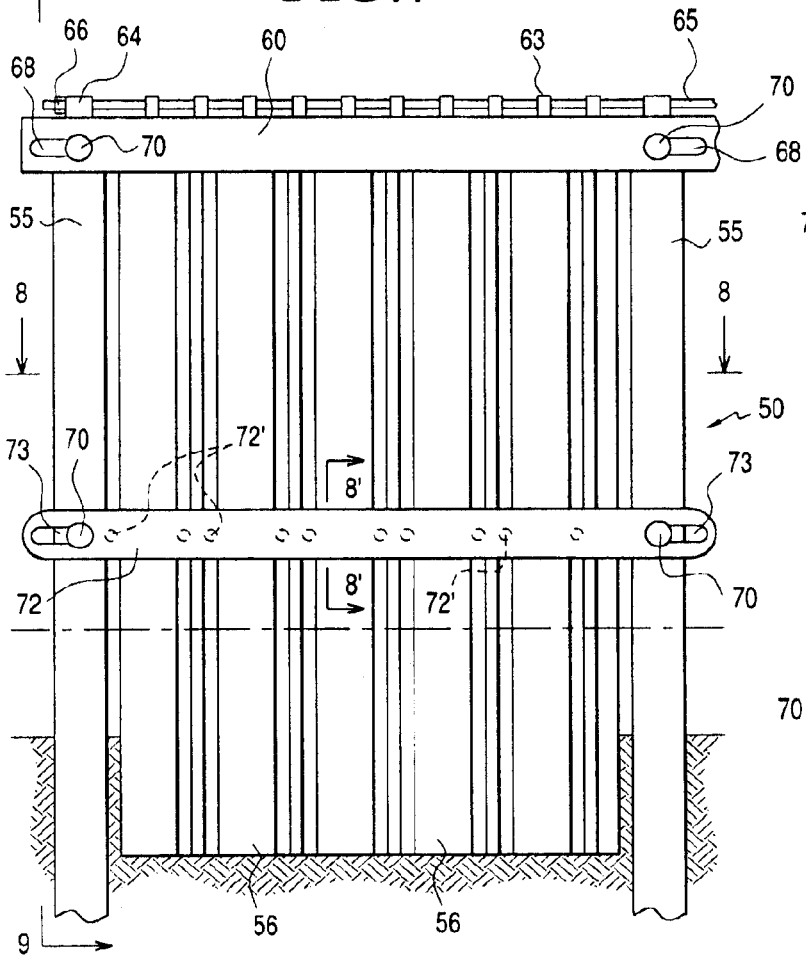
FIG. 7 is a groyne structure section similar to that shown in FIG. 5.
Figure 9:
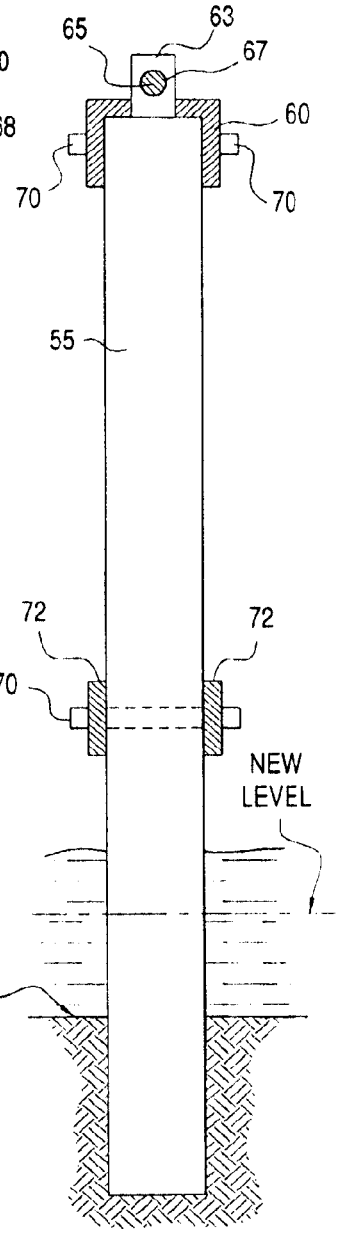
FIG. 9 is an enlarged cross sectional view taken along line 9—9 of FIG.8.

To provide rigidity and connect the elements of the present embodiment together, an upper brace or bar linkage is provided by an elongated inverted U-shaped channel member 60. The member 60 not only functions as a reinforcing bar linkage between the stanchions 55 but also forms a cap for each of the baffle elements 56 and the stanchions 55 of the invention. As shown in FIG. 6, the elongated reinforcing member includes a plurality of spaced openings 62 therein in which tongues 63 integrally formed with each of the baffle elements 56 extend. Similar tongues 64 may be provided extending upwardly from each of the stanchions 55. Each of the tongues 63 and 64 has an opening 67 therethrough, as shown in FIG. 9, through which a locking or suspension bar 65 extends, thereby connecting each of the baffle elements 56 to the stanchions 55. The bar 65 is slidably movable with respect to the baffle elements 56 and retains the elements in vertical alignment with respect to one another as shown in FIG. 7. End nuts 66 may be used to secure the bar 65 in place such that, upon removal of nuts 66, the bars 65 may be removed from supporting relationship with respect to the baffle elements 56 and the stanchions 55.

To allow relative pivotal movement to permit selective elevation of the groyne sections 52 of the groyne 50, elongated slots 68 are provided in spaced relationship on opposite sides of the flanges defining the generally U-shaped reinforcing linkage member 60. The slots permit relative movement between pins 70 which may be fixedly secured to, or removably mounted to, the stanchions 55 in a manner as discussed with respect to the pins disclosed in the embodiment of FIG. 1.

In the present embodiment, it is noted that there is no need to provide any pivot pins between the member 60 and the baffle elements 56 as the elements are supported by the common rod 65.

Figure 8:
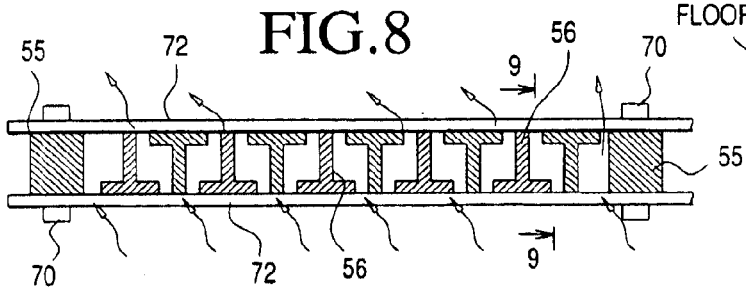
FIG. 8 is a cross sectional view taken along line 8—8 of FIG. 7.
Figure 8:
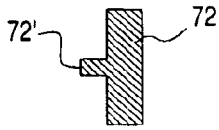
Figure 8:
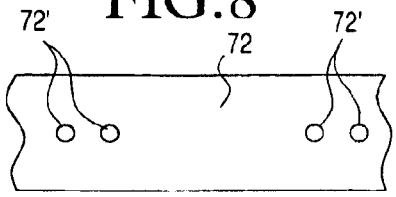

As with the previous embodiment, a second vertically spaced reinforcing linkage bar 72 may be provided to further provide rigidity for the groyne structure. The structure of the linkage bar 72 only varies in that the bar is generally a flat bar having a plurality of slots 73 therein which permit relative movement of the bar with respect to the pins 70 which connect the bar to the stanchions 55. Referring to FIG. 8' and 8", spacers 72' may be integrally formed on the linkage bar 72 to maintain parallel spacing between the baffle elements 56.

Figure 5:
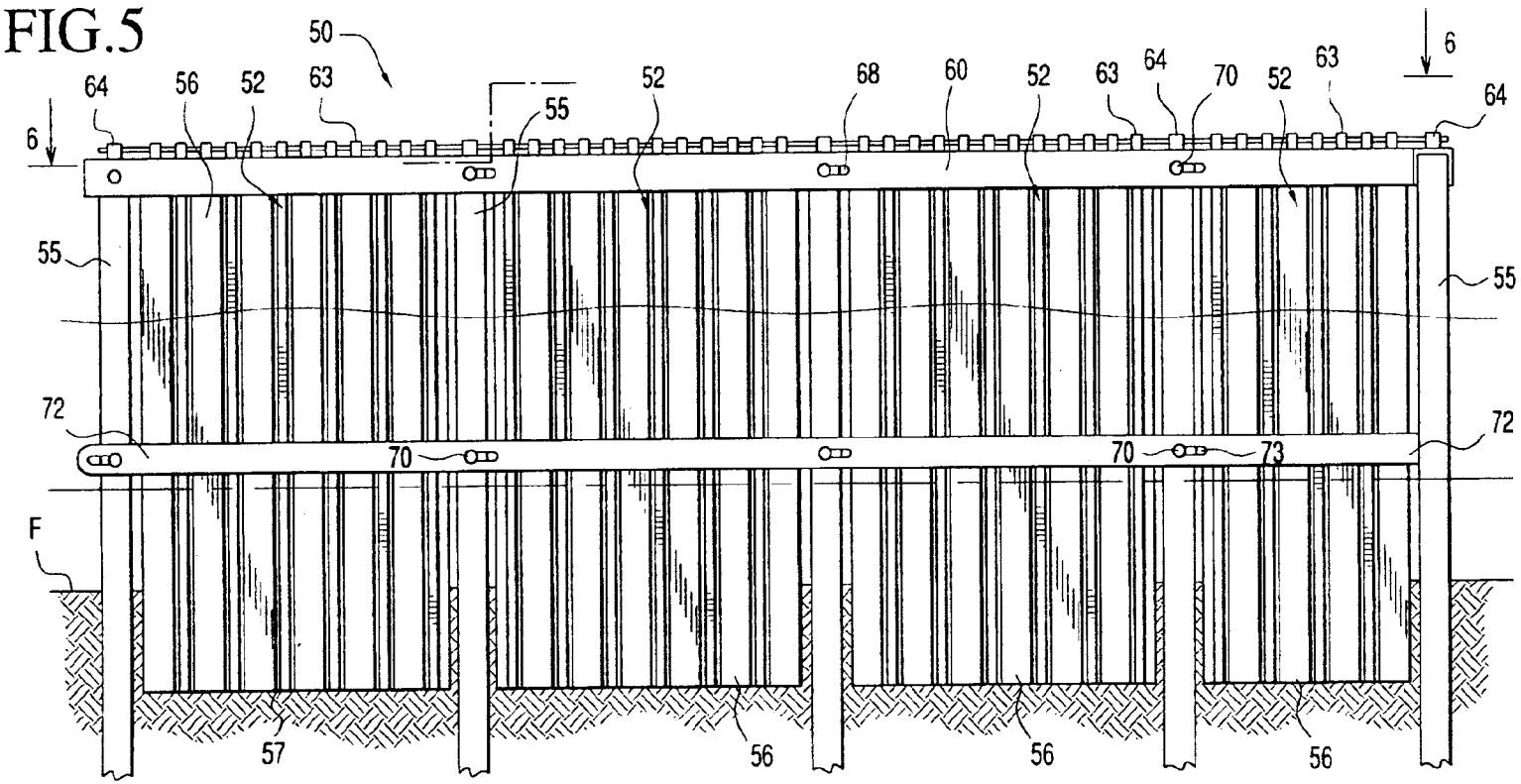
FIG. 5 is a side view of another embodiment of groyne structure in accordance with the teachings of the Invention.

Again, as opposed to providing the structure shown in FIG. 5, each groyne unit 52 may be assembled between two spaced stanchions 55 with the groyne sections being deployed in side-by-side relationship as disclosed in the embodiment in FIG. 1 or as separate groyne sections 55 as shown in FIG. 3.

In some embodiments, as opposed to using the reinforcing bars to connect the baffle elements with the spaced stanchions, it is possible that cables can be extended through the baffle elements and secured at their ends to the space stanchions in order to provide a horizontal link connecting the members to one another, such a link would allow the relative elevation of the members with respect to one another as previously described.

Figure 10:
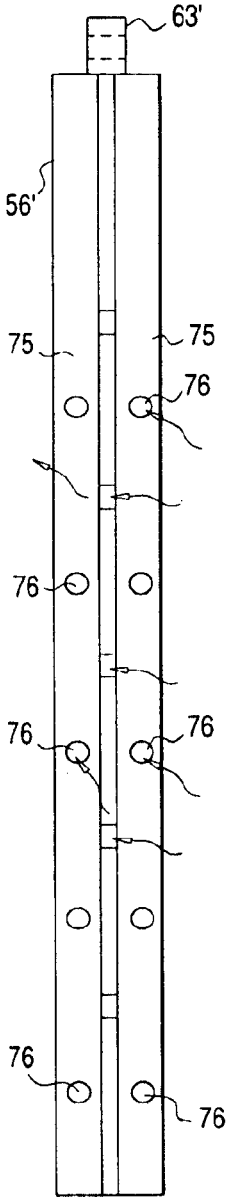
FIG. 10 is a front elevational view of one embodiment of a vertical baffle element used to form the groyne sections of the invention.
Figure 11:
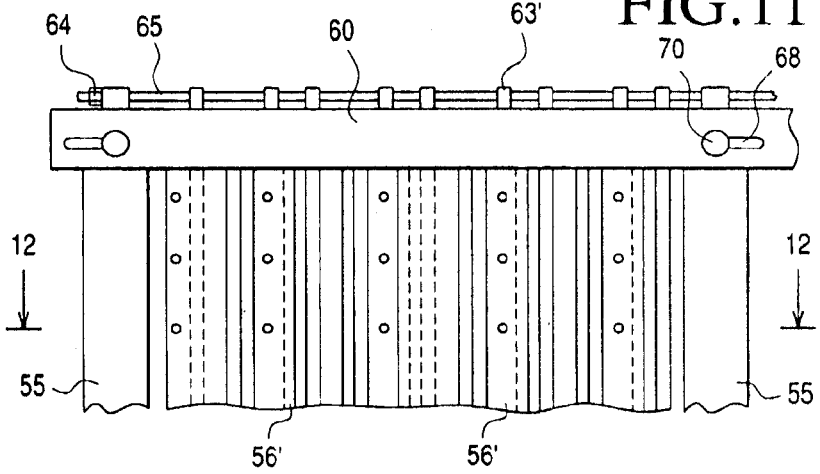
FIG. 11 is a partial side view of a groyne section of the invention incorporating different cross-sectional configurations for the vertical baffle elements in accordance with the teachings of the invention.

With continued reference to FIGS. 10–16, other embodiments of the invention will be described in greater detail. In FIG. 10, a modification of one of the baffle elements 56 shown in the embodiment in FIGS. 5–9 is shown at 56' which is also T-shaped in cross section. In this embodiment, however, flanges 75 of the element are provided with a plurality of openings 76 therethrough for further facilitating the manner in which solids may be encouraged to settle out of water passing through the groyne structure. The size and spacings of the openings 76 may vary and the openings need not be circular but may be of any selected configuration. As shown in FIG. 10, the baffle element 56' also includes an upper tongue 63' having an opening therethrough for selectively receiving an elongated bar 65 as described with respect to the previous embodiment. As shown in FIG. 11, the groyne structure is otherwise generally identical to that shown in the embodiment of FIG. 5. The upper tongue 63' may be the web section of the structural member forming the baffle element 56'.

Figure 12:
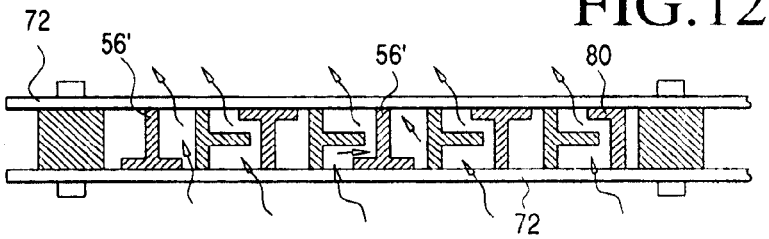
FIG. 12 is a cross-sectional view taken along line 12—12 of FIG. 11.
Figure 13:
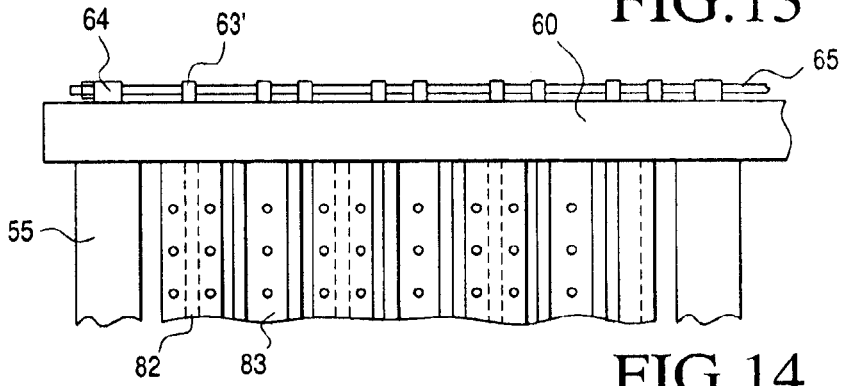
FIG. 13 is a partial side elevational view of another embodiment for groyne sections of the present invention.
Figure 14:
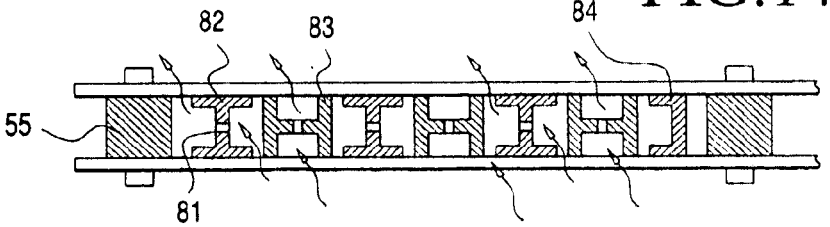
FIG. 14 is a cross-sectional view taken along line 14—14 of FIG. 13.

As previously discussed, the cross section and the orientation of the baffle elements 56 and 56' may vary in each groyne structure. In FIG. 12 the orientation of the T-shaped elements 56' are shown in a varied pattern. A further baffle element 80 having an L-shape configuration is also disclosed.

Figure 15:
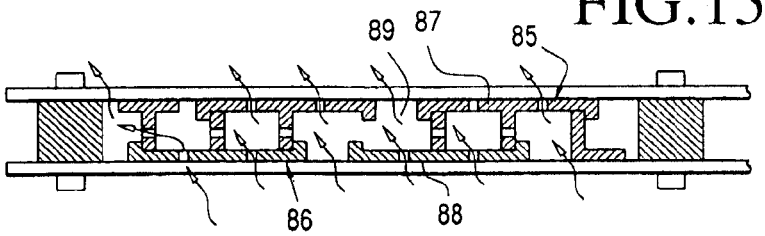
FIG. 15 is a cross-sectional view showing different cross-sectional configurations for the vertical baffle elements of each groyne structure of the invention.
Figure 16:
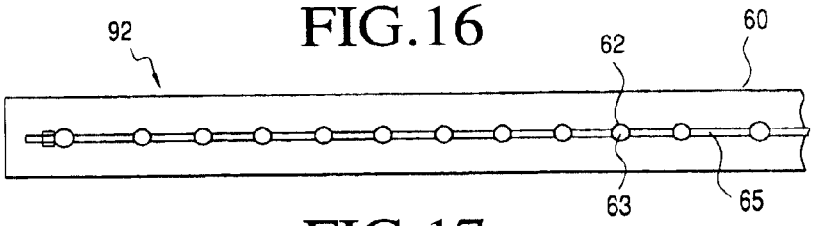
FIG. 16 is a top plan view of one of the groyne cap structures of the invention.
Figure 17:
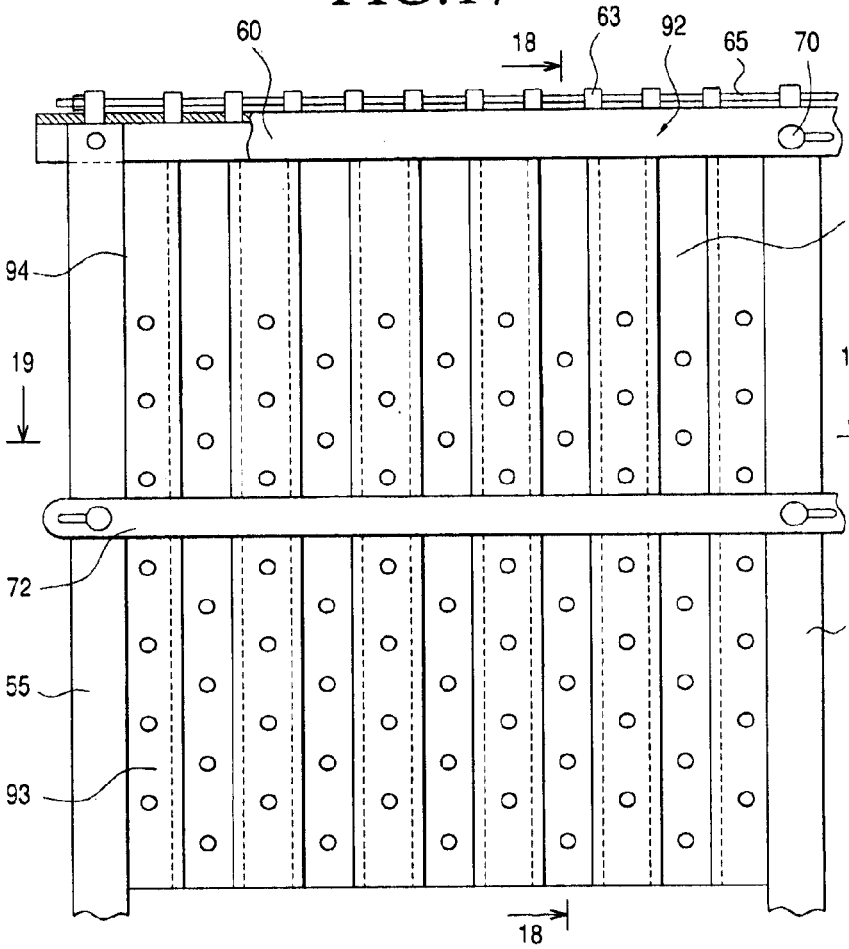
FIG. 17 is a side elevational view of a further embodiment of the present invention wherein the baffle elements are integrally formed with respect to one another.
Figure 18:
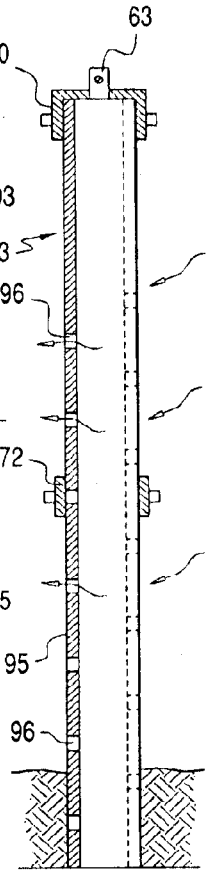
FIG. 18 is a cross-sectional view taken along line 18—18 of FIG. 17.
Figure 19:
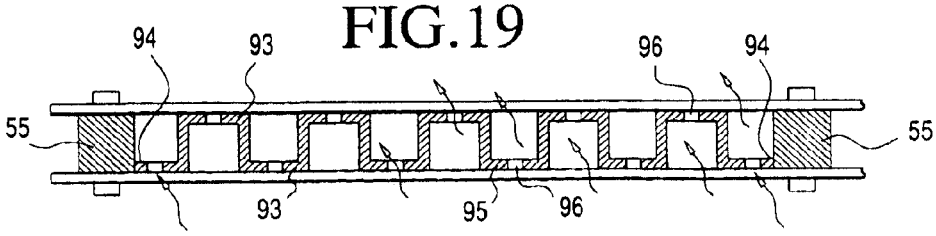
FIG. 19 is a cross-sectional view taken along line 19—19 of FIG. 17.
Figure 20:
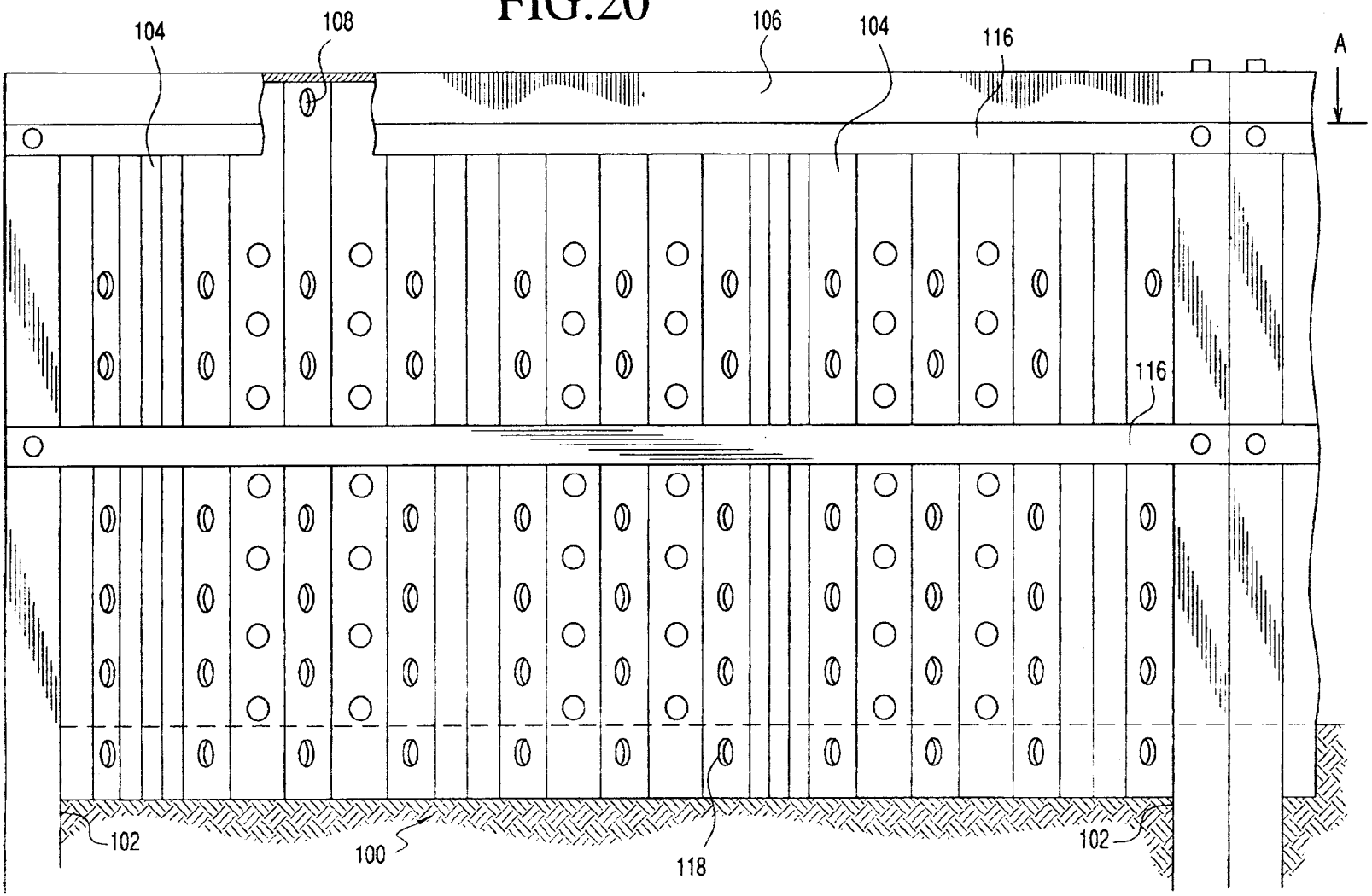
FIG. 20 is a front elevational view having portions broken away of another embodiment of the invention consisting a plurality of slidably interlocked porous baffle elements.
Figure 21:
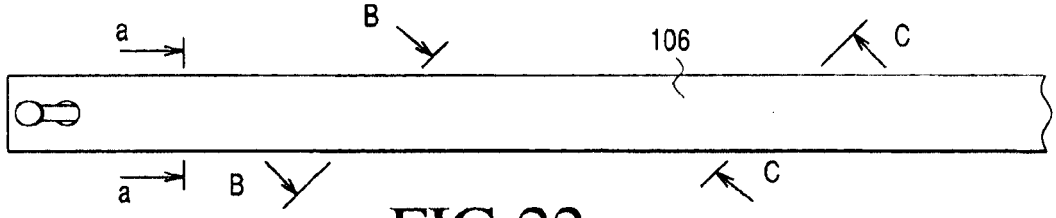
FIG. 21 is a top plane view of the embodiment of FIG. 20.

With respect to FIGS. 13–16, further variations and cross sections of the baffle elements are disclosed. In these embodiments, the baffle elements at 82 may be generally I-shaped and include openings 81 therethrough or they may be "H"-shaped as shown at 83 also having openings 81 therethrough or they may be "C"-shaped as shown at 84 also having openings therethrough. In FIG. 15, combinations of different flange configurations and cross sections as shown at 85 and 86 are also possible. In these instances, several baffle structures may be interconnected by elongated flanges 87 and 88 with openings being provided to create tortuous flow paths such as shown at 89 through the groyne structure. The passage of fluid is generally shown by the arrows in drawing FIG. 15.

In each of these embodiments, the tongues 63 or 63' associated with each of the baffle elements extend through the openings 62 provided in upper linkage member 60.

With respect to FIGS. 16–19, a further embodiment of the invention is disclosed. In this embodiment, each groyne unit 92 includes a plurality of baffle elements 93 which are integrally connected with respect to one another. The structure 93 is thus like a corrugated sheet piling which extends from opposite ends 94 to the space stanchions 55. In the drawings, the sheet piling is shown as being formed with generally U-shaped corrugations 95. Different structures also may be provided. Openings 96 are provided throughout the structure and the number and size of openings will depend upon the conditions existing where the groyne 92 is to be deployed. The integral baffle 93 is deployed between the stanchions and the stanchions may be interconnected as previously discussed using linkages as described with respect to the previous embodiments.

Figure 22:
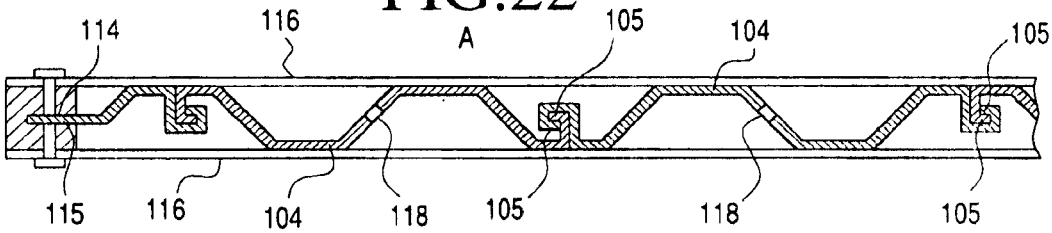
FIG. 22 is a cross sectional view taken along line 22—22 of FIG. 2C.
Figure 23:
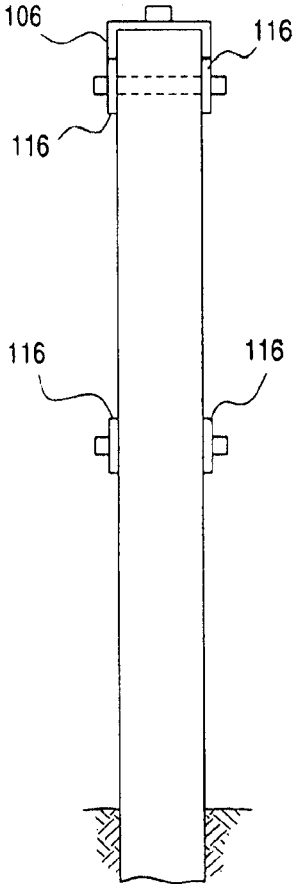
FIG. 23 is a side view of the embodiment of FIG. 20.
Figure 24:
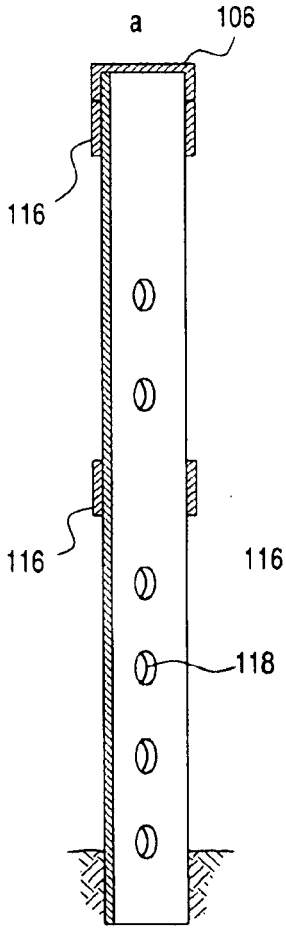
FIG. 24 is a cross sectional view taken along line 24—24 of FIG. 21.
Figure 25:
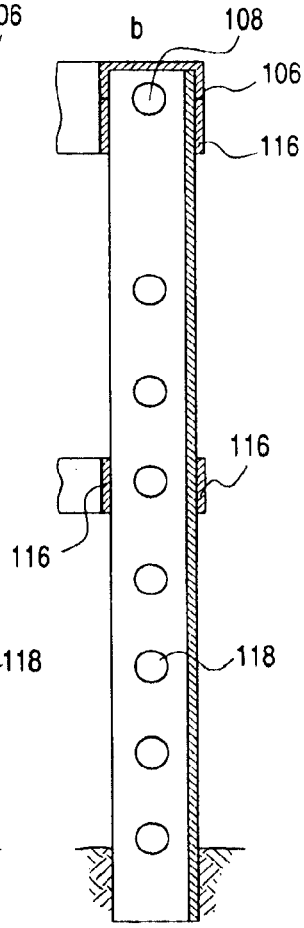
FIG. 25 is a cross sectional view taken along line 25—25 of FIG. 21.

With particular reference to FIGS. 20–26, a further embodiment of the invention is disclosed in detail. In this embodiment, the groyne structure 100 is formed utilizing spaced stanchions 102 similar to those previously disclosed. A plurality or set of baffle elements 104 are provided between pairs of spaced stanchions and are in the form of sheet piles which, in a preferred embodiment, may be corrugated as shown in FIG. 22. Different configurations may also be used and the sheets may even be generally flat.

To rigidify the groyne structure, each of the baffle elements includes generally U-shaped flanged side edges 105 which interlocked with one another, also as shown in FIG. 22. In this manner, the baffle elements are connected to one another so they may be vertically adjusted with respect to one another hut cannot be horizontally separated when deployed. For safety consideration, the groyne structure 100 may also include elongated cap members 106 which are generally U-shaped in cross section and which cover the upper ends of the stanchions and the intermediate set of baffle elements. The caps 106 may be secured by bolts or other fasteners to the stanchions and, in some embodiments, may also be secured to the baffle elements.

Figure 26:
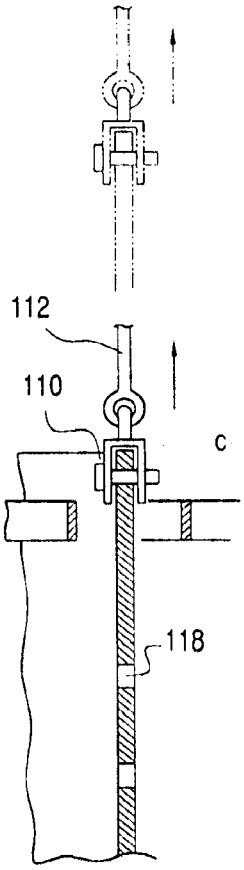
FIG. 26 is a cross sectional illustrational view taken along line 26—26 of FIG. 21 showing a baffle element being elevated.

To facilitate the vertical adjustment of the baffle elements of this embodiment of the invention, each of the baffle elements 104 includes an upper opening 108 through which an appropriate hanger or connector 110 may be secured, as shown in FIG. 26, which connector can be connected to a lifting apparatus such as a hoist cable 112. Prior to vertical adjustment, the cap members 106 are generally removed, afterwhich, each of the baffle elements may be individually elevated to a new height or completely removed, as required.

To provide further stability, the stanchions may included elongated grooves 114 therein in which an outer edge or flange 115 of the end most baffle elements are selectively received, as is shown in FIG. 22.

Elongated horizontal reinforcing bars 116 may be provided on one or both sides of the stanchions and the baffle elements with the bars being constructed as previously described with respect to the other embodiments of the Invention. Further, one or more sets of such reinforcing bars 116 may be used within the teachings of the invention.

As with the previous embodiments, the present groyne structure may also incorporate a plurality of openings 118 of various sizes, configurations and spacings so as to regulate the velocity of fluid flow therethrough in order to facilitate the deposit of solids along the groyne.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A groyne structure for shoreline land mass reclamation including at least one groyne section, said at least one groyne section including a pair of spaced stanchions each having upper and lower ends, a set of vertically extending baffle elements positioned intermediate said pair of spaced stanchions, means for connecting said set of baffle elements to said spaced stanchions including at least one linkage member extending between said pair of spaced stanchions, and means for pivotally connecting said at least one linkage member to said pair of spaced stanchions so that said at least one linkage member is elevated concurrently with said stanchions and so that one of said pair of spaced stanchions may be elevated relative to the other of said pair of spaced stanchions while maintaining said set of vertical baffle elements in generally parallel relationship with respect to one another.

2. The groyne structure of claim 1 including a plurality of linkage members extending between said pair of spaced stanchions, and means for pivotally connecting said plurality of linkage members to said pair of spaced stanchions.

3. The groyne structure of claim 1 including means for pivotally connecting said set of vertical baffle elements to said at least one linkage member.

4. The groyne structure of claim 3 in which said at least one linkage member has slots therein, and said means for pivotally connecting to said pair of spaced stanchions includes pin means extending through said slots.

5. The groyne structure of claim 3 wherein said means for pivotally connecting said set of vertical baffle elements to said at least one linkage member includes pivot pins extending from a plurality of baffle elements forming said set of baffle elements.

6. The groyne structure of claim 1 including at least two linkage members pivotally connected to said pair of spaced stanchions in vertically spaced relationship with one another, and means for pivotally connecting each of a plurality of vertical baffle elements forming said set of vertical baffle elements to at least one of said at least two linkage members.

7. The groyne structure of claim 1 including a cap member extending between and mounted to said upper ends of each of said pair of spaced stanchions, and said cap member being in generally overlying relationship with respect to said set of vertical baffle elements.

8. The groyne structure of claim 1 including a plurality of openings formed in each of a plurality of vertical baffle elements forming said set of vertically extending baffle elements.

9. The groyne structure of claim 8 in which said vertical baffle elements having generally similar cross sections, and said baffle elements being oriented in varying relationships with respect to one another to define tortuous fluid flow passageways therebetween.

10. The groyne structure of claim 8 in which said vertical baffle elements include baffle elements having at least two differing cross sections, and said baffle elements being arranged to define tortuous fluid flow passageways therebetween.

11. The porous groyne structure of claim 1 in which said set of vertical baffle members includes a plurality of integrally connected baffle elements having shaped cross sectional configurations which are formed of a sheet-like material.

12. The groyne structure of claim 3 in which said means for connecting said set of baffle elements to said spaced stanchions includes a tongue extending from an upper end of each of a plurality of baffle elements forming said set, openings in each of said tongues, and means extending between said pair of spaced stanchions and extending through said openings in said tongues for thereby supporting said plurality of baffle elements relative to said pair of spaced stanchions.

13. The groyne structure of claim 12 including a second linkage member, means for pivotally connecting said second linkage member to each of said pair of spaced stanchions.

14. The groyne structure of claim 1 in which said set of baffle elements includes a plurality of vertical baffle elements disposed in spaced relationship with respect to one another to define fluid passageways therebetween.

15. The porous groyne structure of claim 1 wherein said set of vertical baffle elements includes a plurality of spaced baffle elements, said plurality of spaced baffle elements having flanged portions, and openings formed in spaced relationship with respect to one another in said baffle elements.

16. The groyne structure of claim 1 in which said set of baffle elements includes a plurality of spaced baffle elements, each of said plurality of spaced baffle elements having a structural cross sections selected from a group of cross sections consisting of box beam, I-beam, T-beam, L-beam, Z-beam, U-beam or other profiled shape.

17. The groyne structure of claim 1 including a plurality of groyne sections extending in generally linear relationship with respect to one another and at least one secondary groyne section oriented transverse to said plurality of groyne sections to thereby form a breakwater relative to said plurality of groyne sections.

18. The groyne structure of claim 1 in which said set of baffle elements including a plurality of baffle elements each having at least one side edge which is interfitted with a side edge of an adjacent baffle element such that said plurality of baffle elements may be moved vertically relative to one another but are restrained from horizontal separation relative to one another.

19. The groyne structure of claim 18 including means for slidably engaging at least one of said plurality of baffle elements with one of said spaced stanchions.

20. The groyne structure of claim 18 including a plurality of openings through at least one of said plurality of baffle elements.

21. The groyne structure of claim 18 including means for elevating said plurality of baffle elements.

22. The groyne structure of claim 18 in which each of said plurality of baffle elements is formed of a corrugated sheet material.

23. A groyne structure for shoreline land mass reclamation including at least one groyne section, said at least one groyne section including a pair of spaced stanchions each having upper and lower ends, a plurality of vertically extending baffle elements positioned intermediate said pair of spaced stanchions, means for connecting said plurality of baffle elements to one another and to said spaced stanchions such that said plurality of baffle elements are vertically movable relative to one another but are restrained from horizontal separation from one another as said pair of spaced stanchions are alternately raised and whereby said plurality of baffle elements and said pair of spaced stanchions may be elevated relative to one another while maintaining said plurality of vertical baffle elements in generally parallel relationship with respect to one another.

24. A method of forming a permanent or semi-permanent groyne structure for shoreline and land mass reclamation comprising the steps of:

a. providing at least one pair of spaced stanchions having upper and lower ends,
b. providing a plurality of vertical baffle elements,
c. connecting the plurality of baffle elements to the pair of spaced stanchions whereby one of the spaced stanchions may be elevated relative to the other,
d. deploying said groyne structure along a shoreline so as to extend from the shore to offshore, and
e. vertically adjusting the deployed groyne structure by selectively elevating one of said at least one pair of spaced stanchions relative to the other while retaining said plurality of baffle elements in generally parallel relationship with respect to one another and thereafter raising the other of the at least one pair of spaced stanchions to thereby raise said plurality of baffle members.

25. The method of claim 24 including the additional step of interlocking the plurality of vertical baffle elements to one another such that the plurality of baffle elements are movable vertically relative to one another but are not separable horizontally.

26. The method of claim 24 including the additional step of pivotally connecting the plurality of vertical baffle elements relative to one another.

* * * * *